United States Patent [19]

Miyagi et al.

[11] 4,364,349

[45] Dec. 21, 1982

[54] METHOD FOR CONTROLLING THE OPERATION OF THE FUEL INJECTOR IN A FUEL INJECTION TYPE INTERNAL COMBUSTION ENGINE DURING A DECELERATION CONDITION OF THE ENGINE

[75] Inventors: Hideo Miyagi, Okazaki; Toshio Suematsu, Toyota, both of Japan

[73] Assignee: Toyota Jidosha Kogyo Kabushiki Kaisha, Toyota, Japan

[21] Appl. No.: 286,665

[22] Filed: Jul. 24, 1981

[30] Foreign Application Priority Data

Sep. 17, 1980 [JP] Japan ..... 55-127876

[51] Int. Cl.[3] ..... F02D 11/10; F02D 31/00

[52] U.S. Cl. ..... 123/339; 123/325; 123/491; 123/493

[58] Field of Search ..... 123/493, 491, 339, 325, 123/179 G

[56] References Cited

U.S. PATENT DOCUMENTS

| | | | |
|---|---|---|---|
| 4,094,274 | 6/1978 | Harada | 123/493 |
| 4,148,283 | 4/1979 | Harada | 123/493 |
| 4,266,521 | 5/1981 | Williams | 123/493 |

*Primary Examiner*—Ronald B. Cox

*Attorney, Agent, or Firm*—Stevens, Davis, Miller & Mosher

[57] ABSTRACT

An electronic fuel injection control internal combustion engine which is provided with a feedback control system for maintaining a predetermined constant idling speed and a system for controlling the operation of the fuel injector during the deceleration condition of the engine. A value of the rotational speed when the fuel injector is stopped or recovered is increased during the deceleration condition of the engine.

7 Claims, 8 Drawing Figures

METHOD FOR CONTROLLING THE OPERATION OF THE FUEL INJECTOR IN A FUEL INJECTION TYPE INTERNAL COMBUSTION ENGINE DURING A DECELERATION CONDITION OF THE ENGINE

FIELD OF THE INVENTION

The present invention relates to a method for controlling the fuel injector in a computer controlled fuel injection type internal combustion engine during the deceleration condition of the engine.

BACKGROUND OF THE INVENTION

The computer controlled internal combustion engine has an idling rotational speed control feed back system for maintaining a predetermined constant rotational idling speed. However, the idling control system operates unsatisfactorily due to an over-shoot effect which occurs during a short period after the engine is started. Therefore, the idling rotational speed become high. In this case, the increased rotational speed may exceed a predetermined value above which the operation of the fuel injector is stopped during the deceleration condition of the engine. As a result of this, a sharp decrease in idling rotational speed takes place, so that the idling operation becomes unstable.

SUMMARY OF THE INVENTION

An object of the present invention is to provide a method for controlling the operation of the fuel injector during the deceleration of the engine, so that a stable idling operation is maintained during the short period after the engine is started.

According to the present invention a method is provided for operating a fuel injector device in a computer controlled fuel injection type internal combustion engine during a fully closed position of throttle valve of the engine in which idling engine speed is controlled so that it is maintained to $N_F$, said method comprising the steps of:

(a) storing, in a memory unit of the electrical computer, a value corresponding to a first rotational speed $N_1$;

(b) storing, in the memory unit, a value corresponding to a second rotational speed $N_2$ which is smaller than $N_1$ and is larger than the idling rotational speed $N_F$;

(c) storing, in the memory unit, a value corresponding to an increase $\alpha$ in the first rotational speed $N_1$;

(d) storing, in the memory unit, data corresponding to an increase $\beta$ in the second rotational speed of the engine $N_2$;

(e) detecting whether a predetermined period has lapsed or not from the start of the engine;

(f) producing an electrical signal for stopping the operation of the fuel injector device when said period has not lapsed and when the rotational speed of the engine N is larger than $N_1$ plus $\alpha$;

(g) producing an electrical signal for operating the fuel injector device when said period has not lapsed and when the rotational speed of the engine N is smaller than $N_2$ plus $\beta$;

(h) producing the electrical signal for stopping the operation of the fuel injector when the period has lapsed and when the rotational speed of the engine N is larger than $N_1$;

(i) producing the electrical signal for operating the fuel injector when the period has lapsed and when the rotational speed of the engine N is smaller than $N_2$;

(j) repeating the above mentioned steps during the fully closed condition of the throttle valve of the engine.

DESCRIPTION OF THE PREFERRED EMBODIMENTS

Figure 1:
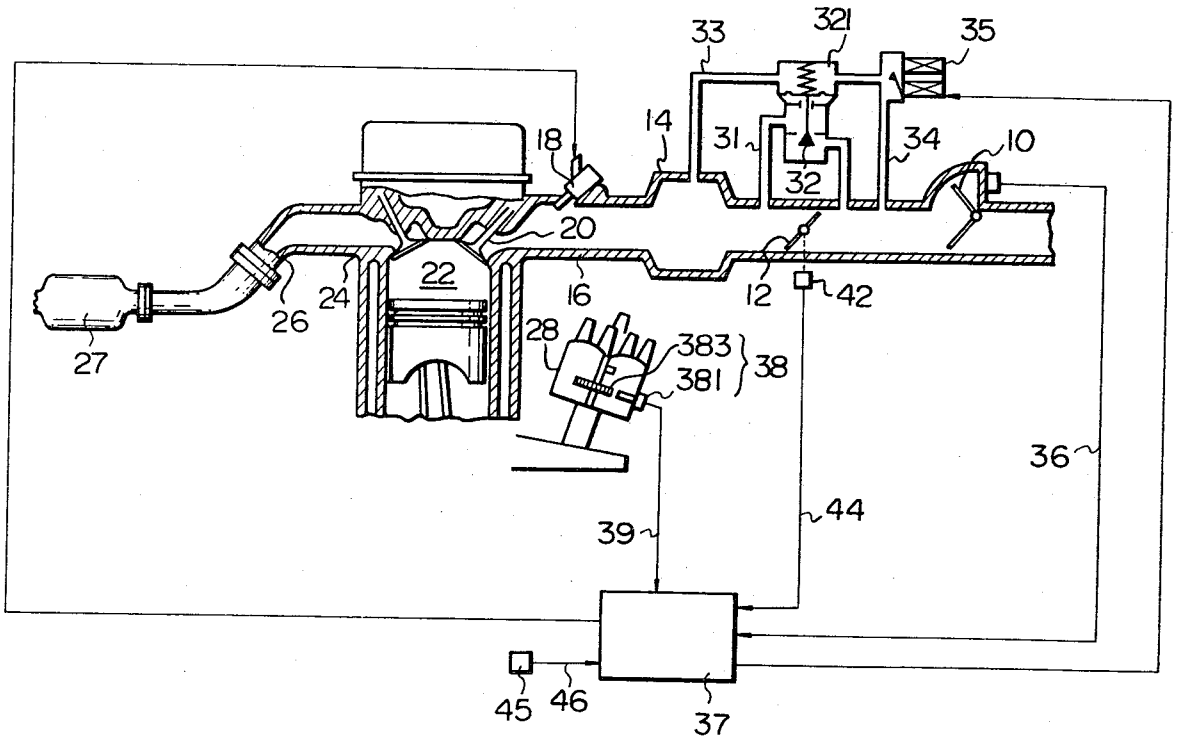
FIG. 1 is a schematic view of an electric fuel injection control internal combustion engine.

Referring to FIG. 1, showing an electrical fuel injection type internal combustion engine, numeral 10 denotes an air flow meter for detecting the amount of intake air introduced into the engine from an air cleaner (not shown). The air is, via a throttle valve 12, directed to a surge tank 14. From the surge tank 14 the air is distributed to an intake manifold 16. The distributed air, together with fuel from a fuel injector 18, is introduced into a combustion chamber 22 via an intake valve 20. A resultant combustible mixture is, at a predetermined crank angle determined by a distributor 28, ignited by an electrode (not shown). Exhaust gas is discharged to an exhaust manifold via an exhaust valve 24. A catalytic converter 27 located downstream of the exhaust manifold 26 serves to purify toxic components included in the exhaust gas.

In addition to the above mentioned basic components, the engine includes a feed back control system for maintaining a predetermined constant idling speed of the engine. The system has a passageway 31 by-passing the throttle valve 12. A flow control valve 32 is arranged in the passageway for controlling the amount of air passed through the passageway 31. The flow control valve 32 is provided with a vacuum operating chamber 321 which is connected to the surge tank 14 at a position downstream of the throttle valve 12 via a vacuum line 33 for allowing the introduction of a vacuum signal from the surge tank 14 to the vacuum operation chamber 321. The chamber is also connected to the intake line at a position upstream of the throttle valve 12 via a passageway 34 on which an electromagnetic valve 35 is arranged. When the valve 35 is opened, the chamber 321 is connected to the upstream side of the throttle valve, which is under an atmospheric pressure. Therefore the chamber 321 is under the atmospheric pressure irrespective of the vacuum pressure in the surge tank 14. Therefore, the opening of the flow control valve becomes large, so that a large amount of air is passed through the passageway 31 during the idling condition of the engine. When the electro-magnetic valve 35 is closed, the chamber 321 is disconnected from the upstream side of the throttle valve 12. Thus, the chamber 321 is under a vacuum pressure, so that the opening of the flow control valve 32 is small. Thus, a small amount of the air can be passed through the by-pass passageway 31.

The air flow meter 10 provides an electrical signal indicating the amount of intake air, which signal is delivered via an electrical signal line 36 to a control circuit 37 comprised of an electrical computer. A crank angle pulse sensor 38 is arranged in the casing of the distributor 28, which sensor is comprised of a detector unit 381 and a toothed member 383 fixed to a distributing shaft of the distributor 28. Therefore, a pulsative signal having a predetermined number of pulses during one rotation of the shaft, i.e., one rotation of the engine, is issued from the sensor 38 via an electrical line 39 toward the control circuit 37. A throttle position sensor 42, cooperating with the throttle valve 12, serves to provide an electrical signal indicating a fully closed position of the throttle valve 12 via an electrical line 44. An engine start sensor 45 is connected to the unit 37 via an electrical line 46 and is provided for detecting a starting condition of the engine. A sensor 45 is made as a switch cooperating with a starter switch for operating a starter motor of the engine can be utilized.

Figure 2A:
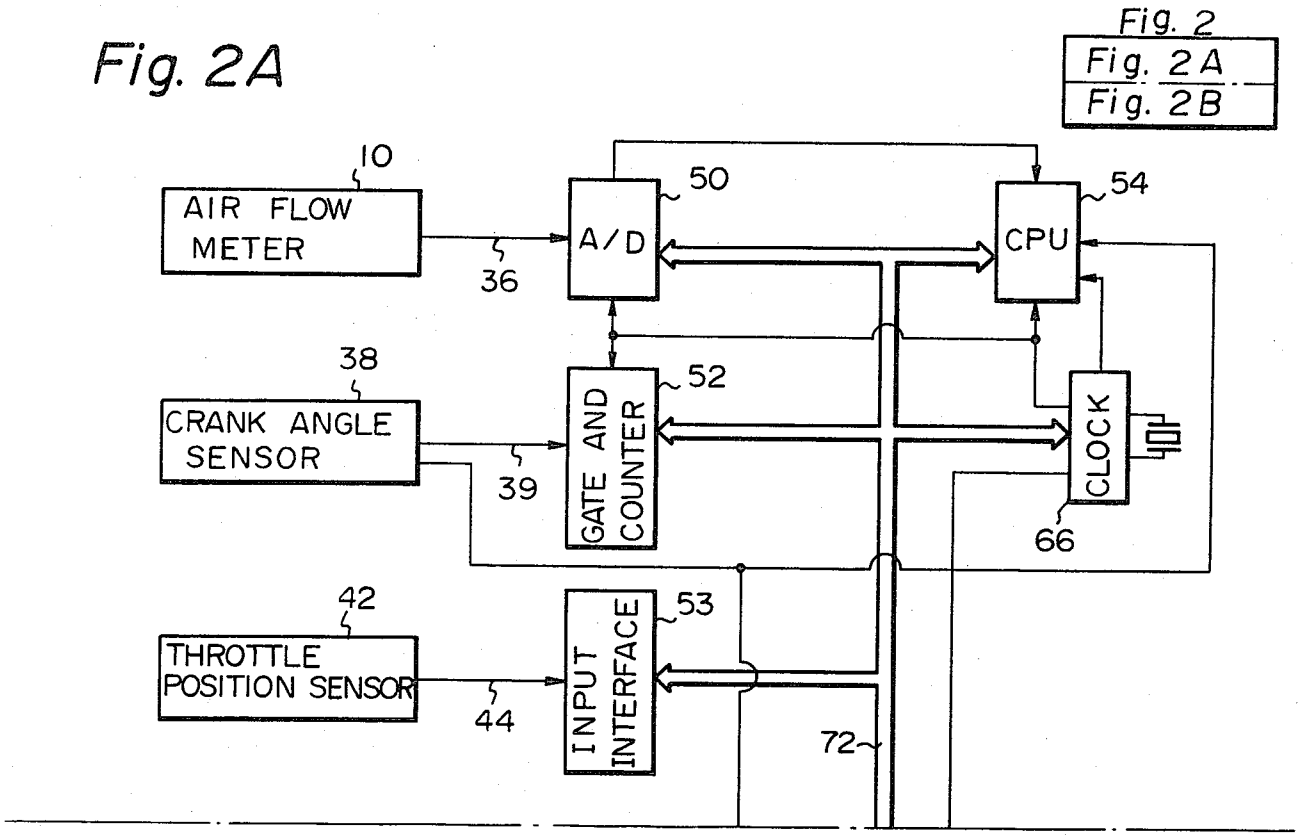
FIGS. 2A and 2B show a diagrammatic view of the electrical control unit in FIG. 1.
Figure 2B:
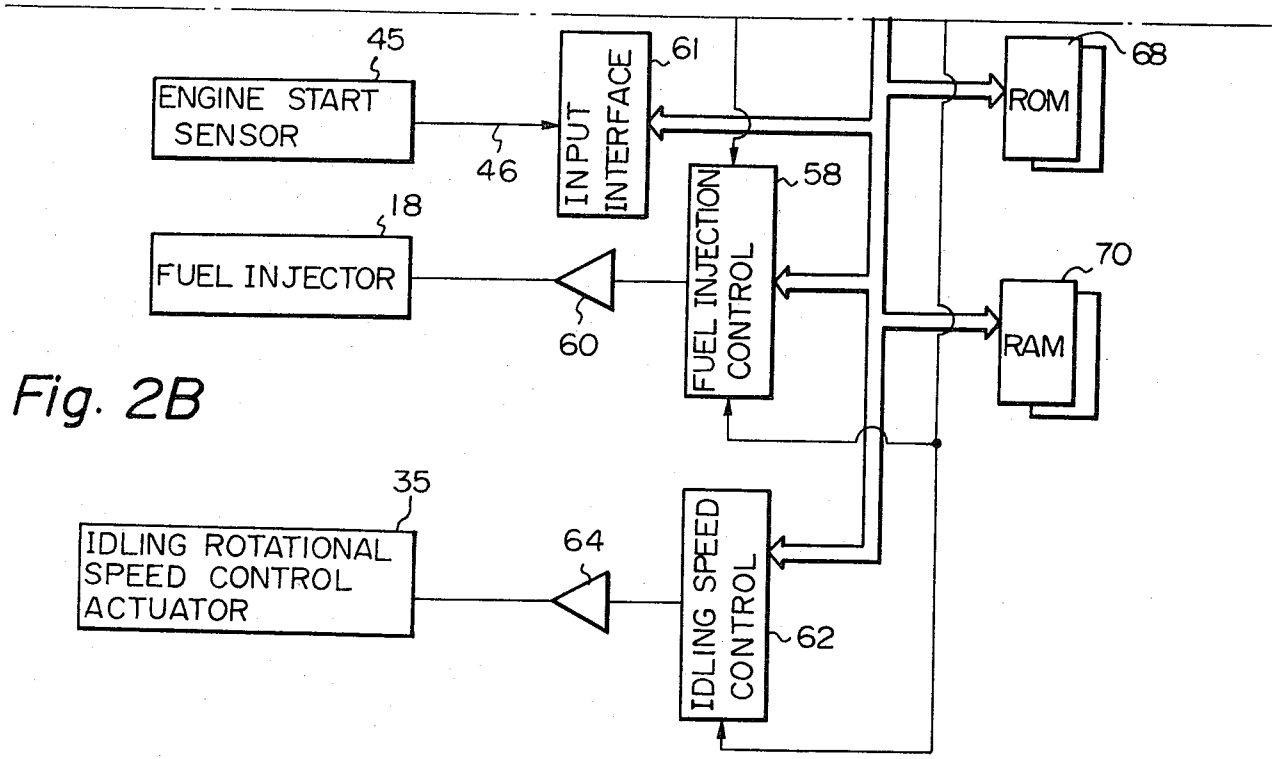

A diagrammatic construction of the electrical control unit 37 is shown in FIG. 2. An analogue signal from the air flow meter 10 is received by an analogue-to-digital converter 50. A pulsative signal from the crank angle pulse sensor 38 is received by a gate-and-counter unit 52 which forms a signal which corresponds to the rotational speed N of the engine.

A signal from the throttle position sensor 42 is received by an input interface unit 53 and stored in a resistor thereof.

The control circuit 37 includes a fuel injection control circuit 58 which is comprised of a counter and a resistor unit. At a predetermined timing of the engine operation, the fuel injection circuit issues a pulse for operating a power amplifier unit 60 for driving the fuel injector device 18.

A signal from the engine start sensor 45 is received by an input interface 61 and stored in a resistor thereof.

An idling rotational speed control circuit 62 is comprised of a gate-and-counter unit. The idling speed control circuit 62 is connected to a power amplifier 64 for operating the electro-magnetic valve 35 as an idling rotational speed control actuator.

The A/D converter 50, the gate-and-counter circuit 52, the interfaces 53 and 61, the fuel injection control circuit 58 and the idling rotational speed control circuit 62 are via a bus 72 connected to basic components for constructing a micro-computer system, including a CPU 54, a clock generator 66, an ROM 68 and an RAM 70, so that the transmission of input and output data are effected between these parts.

A control of the idling condition of the engine is effected under a predetermined program instructed by the CPU 54. Now, the control of the rotational speed during the idling condition will be briefly explained. Idling is sensed by the fully closed position of the throttle valve 12 detected by the throttle position sensor 42. When a rotational speed of the engine N sensed by the sensor 38 is lower than a predetermined idling rotational speed $N_F$, the idling rotational speed control circuit 62 provides a signal for causing the power amplifier 64 to energize the electro-magnetic valve 35. As a result of this, the valve 35 is opened for generating atmospheric air pressure in the chamber 321 of the flow control valve 32. Thus, the opening of the flow control valve 32 is increased for effecting a large amount of air to be passed through the by-pass passageway 31. Due to the large amount of air, the rotational speed of the engine N is increased, so that it is higher than the predetermined idling rotational speed $N_F$. When the rotational speed of the engine N sensed by the sensor 38 is higher than the predetermined idling rotational speed $N_F$, the idling rotational speed control circuit 62 provides a signal for causing the electro-magnetic valve 35 to be de-energized. As a result of this, the valve 35 is closed for generating a vacuum pressure in the chamber 321 of the flow control valve 32. Therefore, opening of the flow control valve 32 is decreased and a small amount of air is passed through the by-pass passageway 31. Due to the small amount of the intake air introduced into the engine, the rotational speed of the engine N is decreased, so that it is lower than the predetermined idling rotational speed $N_F$. Due to the repetition of the above mentioned closing or opening of the flow control valve 32, the rotational speed of the idling condition of the engine N is maintained at the predetermined idling rotational speed $N_F$.

Figure 3:
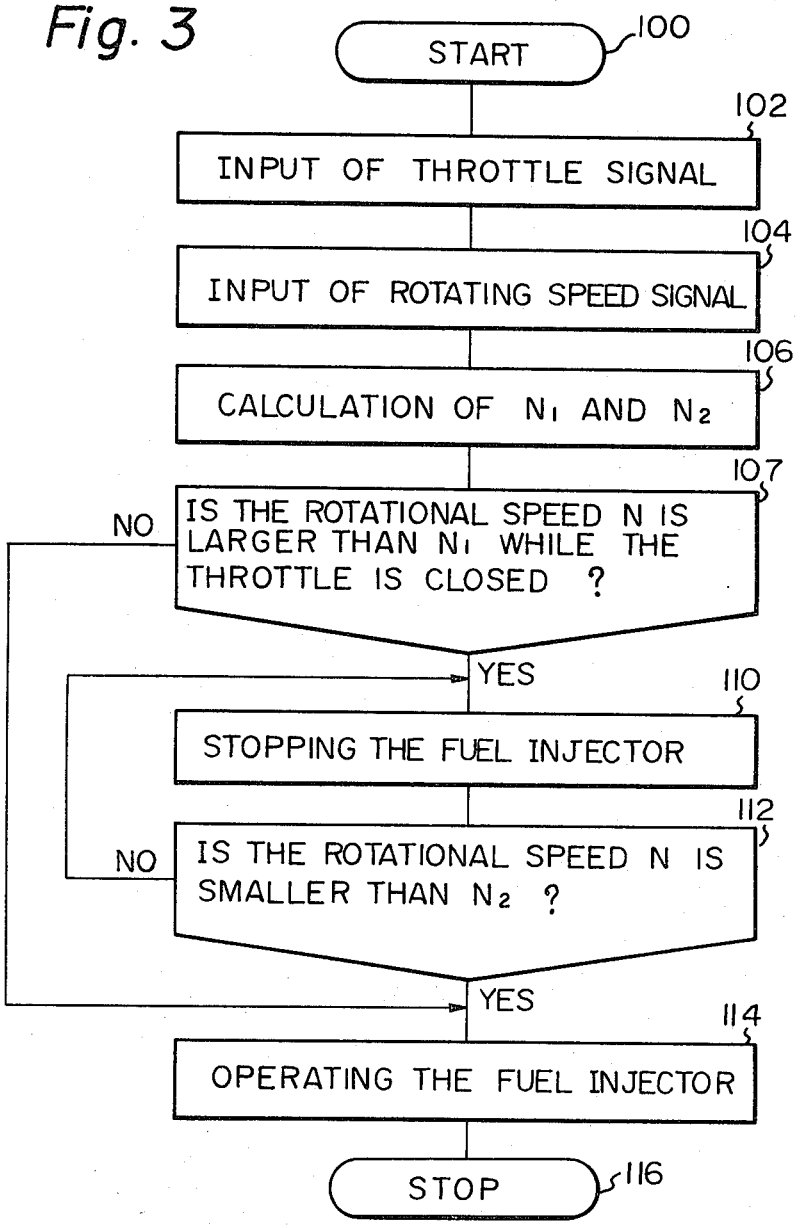
FIG. 3 shows a program for controlling the fuel injection during deceleration.

In the above computer system, the control of the fuel supply during deceleration of the engine is effected under a predetermined program, as diagramatically shown in FIG. 3. Now a routine effected by this program will be explained.

At a step 100, the program enters into the calculation.

At a step 102, the CPU 54 reads out a value in the resister of the unit 53, indicating the degree of the opening of the throttle valve 12.

At a step 104, the CPU 54 reads out a value in the resister of the unit 52, indicating the rotational speed N of the engine.

Figure 4:
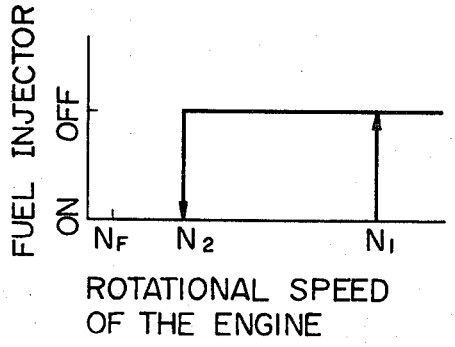
FIG. 4 shows a relation between the rotational speed and the operational conditions of the fuel injector.

At a step 106, the CPU effects a calculation of the values of the predetermined rotational speeds $N_1$ and $N_2$. The value $N_1$ indicates a rotational speed of the engine during deceleration wherein the fuel injector 18 is immobilized (see FIG. 4). The value $N_2$ indicates a rotational speed of the engine during deceleration, wherein the operation of the fuel injector 18 is allowed. The value $N_2$ is lower than $N_1$, although it is higher than the idling rotational speed $N_F$.

At a step 107, the CPU determines whether the rotational speed N, sensed by the sensor 38, is larger than the predetermined value $N_1$ or not. If the determination at the step 107 is YES, at the next step 110, a resister of the fuel injection control circuit 58 has a low level value, so that the fuel injection valve 18 is de-energized. Thus, a supply of fuel from the injector 18 to the engine is stopped. Due to the stop of the supply of fuel, the rotational speed N of the engine sensed by the sensor becomes smaller than the predetermined rotational speed $N_2$.

At a step 112, the CPU determines whether the rotational speed N sensed by the sensor is larger than the predetermined value $N_2$ or not. If the determination at the step 112 is YES, the program proceeds to step 114. At the step 114, the resister of the fuel injection control circuit 58 has a high level value, so that the fuel injector 18 can operate (see FIG. 3). Thus, control of the supply of fuel during deceleration of the engine is effected.

At the step 116, the program is stopped.

The control of the idling speed of the engine is ideally effected after a sufficient time has lapsed from the starting of the engine for obtaining a stable condition of the engine. In other words, the ilding rotational speed is controlled to the predetermined value $N_F$ after a predetermined period has lapsed, as shown by a line q in FIG. 5. During the starting of the engine, the idling rotational speed is apt to be increased to a larger value than the predetermined speed, as shown by a line p in FIG. 5, due to a so-called over-shoot effect in the feed back control system. In this case the rotational speed of the engine can exceed the previously mentioned predetermined value $N_1$, where the operation of the fuel injector 18 is stopped. Due to the stopping of the fuel injector 18, the rotational speed of the engine is rapidly decreased, as shown by a dotted line 1 in FIG. 5, so that a stable idling operation of the engine can not be carried out. The present invention can, as will fully described hereinbelow, overcome such a drawback as encountered in the prior art.

Figure 6:
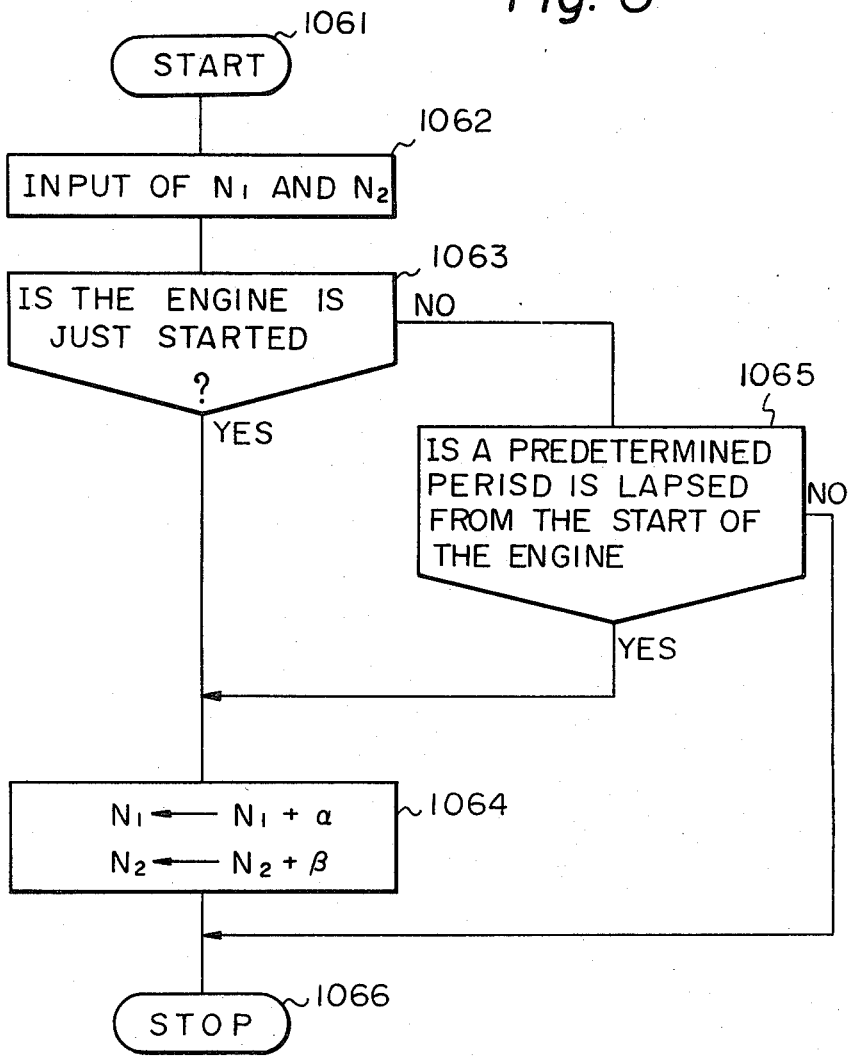
FIG. 6 shows a routine for effecting a determination of $N_1$ and $N_2$.

According to the present invention, the step 106 in FIG. 3 for calculating the predetermined values $N_1$ and $N_2$ is constructed as shown by FIG. 6. A step 1061 indicates that the sub-routine in FIG. 6 interrupts the main routine in FIG. 3.

At the next step 1062, the CPU 54 reads the values of the predetermined rotational speeds $N_1$ and $N_2$ stored in the respective memory cells of the ROM 68.

At the step 1063, the CPU 54 reads the resister of the input interface 61, and determines whether the starter motor of the engine has operated or not.

A result of YES at the step 1063 indicates that the engine has just started. In this case, at a step 1064 the CPU effects a calculation of $N_1+\alpha$ and $N_2+\alpha$. This means that a rotational speed where the fuel injector 18 during deceleration is stopped and a rotational speed N where the fuel supply during deceleration is reset are increased to $N_1+\alpha$ and $N_2+\alpha$, respectively, from $N_1$ and $N_2$, respectively.

A result of NO at the discrimination at the step 1063 indicates that the engine has already started. In this case, at the step 1065, the CPU 54 discriminates whether a predetermined short period a has lapsed from the starting of the engine or not.

If the discrimination at the step 1065 is YES, the program proceeds to the previously mentioned step 1064, so that the increase of the rotational speed from $N_1$ to $N_1+\alpha$ and from $N_2$ to $N_2+\alpha$ is maintained.

If the discrimination at the step 1065 is NO, the predetermined period a is lapsed from the starting of the engine wherein the idling of the engine is already fully stable. In this case, the values of the rotational speed are maintained at $N_1$ and $N_2$.

At the step 1066 the interrupt procedure of this subroutine is ended.

Figure 5:
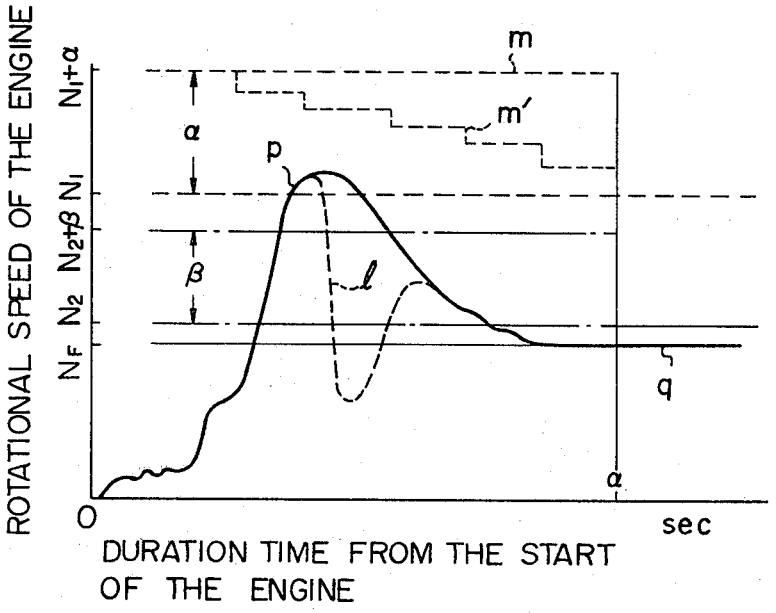
FIG. 5 shows a relation between a duration time after the engine is started and the idling rotational speed of the engine.

According to the present invention, during the deceleration of the engine, the rotational speed of the engine where the supply of fuel is stopped is increased to $N_1+\alpha$, as shown by a line m in FIG. 5 until a predetermined short period a, from the start of the engine, has lapsed. Therefore, the rotational speed of the engine does not exceed the increased predetermined rotational speed $N_1+\alpha$, even if the over-shoot of the idling rotational speed takes place, as shown by the line p in FIG. 5. Therefore, the fuel supply is not affected by the programed system for controlling the fuel supply during the deceleration of the engine. Thus, a stable idling operation can be carried out when the engine is started.

Figure 7:
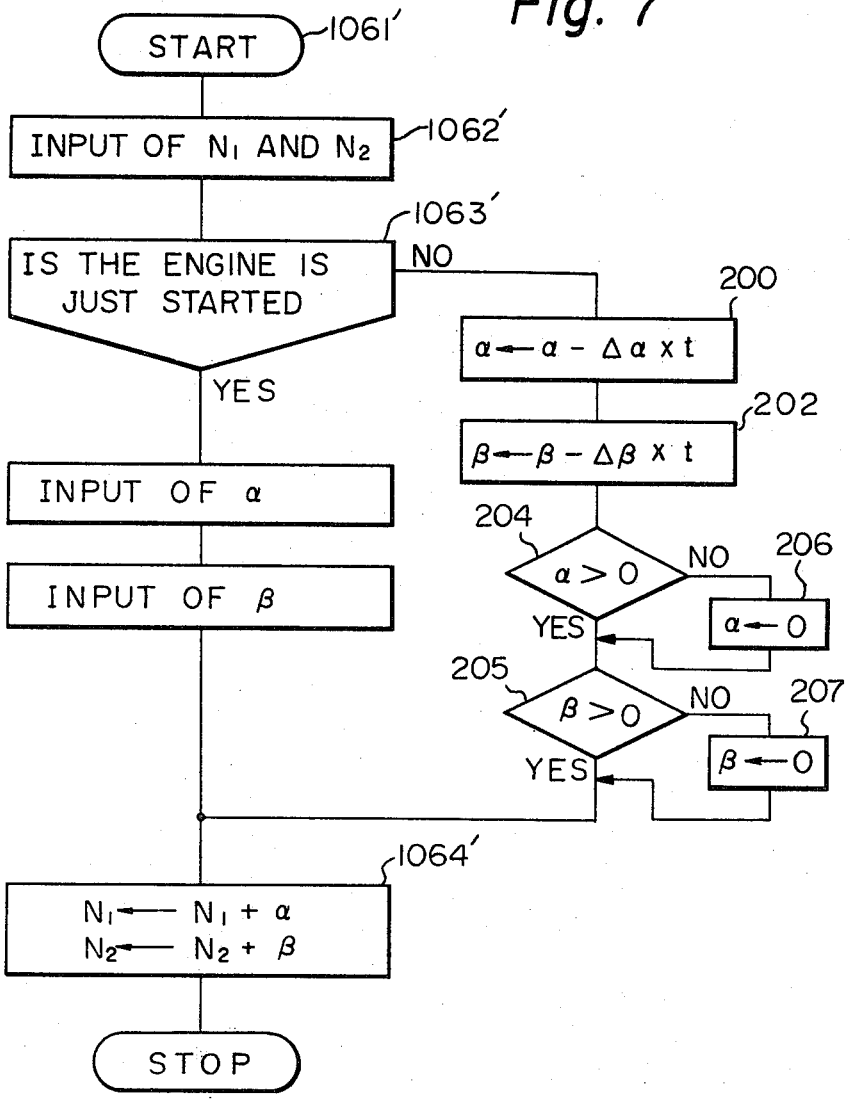
FIG. 7 shows another embodiment for determining $N_1$ and $N_2$.

FIG. 7 indicates a second embodiment of the present invention.

Steps 1061', 1062' and 1063' correspond to the steps 1061, 1062 and 1063, respectively, in FIG. 6.

A result of YES at the step 1063' indicates that the engine is just starting. In this case, values of the rotational number $N_1+\alpha$ and $N_2+\beta$ are stored in the respective memory units of the computer at step 1064' similar to the step 1064 in FIG. 6. Thus, the control of the fuel injector takes place at the increased rotational speed $N_1+\alpha$ and $N_2+\beta$, as already described with reference to FIG. 7.

If the discrimination at the step 1063' is NO, the program proceeds to step 200. At the step 200 a calculation, $\alpha-\Delta\alpha\times t$ is effected, wherein t means a duration time after the engine is started, and $\Delta\alpha$ means an increment of $\alpha$.

At the step 202 a calculation $\beta-\Delta\beta$ is effected.

At steps 204, 205 it is determined whether $\alpha$ or $\beta$ is larger than 0 or not. If the determination at the step 100 or 102 is YES, the value of the program proceeds to the step 1064'. In this case, the value of the rotational speed is increased to $N_1+(\alpha-\Delta\alpha\times t)$ and $N_2+(\beta-\Delta\beta\times t)$, respectively, from $N_1$ and $N_2$, respectively.

A determination of NO at step 104 or 106, indicates that the increase of the rotational speed is not necessary. In this case $\alpha$ is changed to, at step 206 or 207, zero. Therefore, the value of the rotational speed is maintained at $N_1$ and $N_2$.

According to this embodiment, a step-like decrease of the value $\alpha$ is effected, as shown by phantom line m' in FIG. 5.

In this embodiment, in place of detecting the time t from the start of the engine, values of $\Delta\alpha$ and $\Delta\beta$ can be progressively decreased in accordance with each rotation of the engine.

It should be noted that, in place of dectecting a time t after the starter is started, it is possible to detect a time after the starter motor of the engine is de-energized.

We claim:

1. Method for operating a fuel injector device in a computer controlled fuel injection type internal combustion engine during a fully closed position of throttle valve of the engine in which idling engine speed is controlled so that it is maintained to $N_F$, said method comprising the steps of:

(a) storing, in a memory unit of the electrical computer, a value corresponding to a first rotational speed $N_1$;

(b) storing, in the memory unit, a value corresponding to a second rotational speed $N_2$ which is smaller than $N_1$ and is larger than the idling rotational speed $N_F$;

(c) storing, in the memory unit, a value corresponding to an increase $\alpha$ in the first rotational speed $N_1$;

(d) storing, in the memory unit, data corresponding to an increase $\beta$ in the second rotational speed of the engine $N_2$;

(e) detecting whether a predetermined period has lapsed or not from the start of the engine;

(f) producing an electrical signal for stopping the operation of the fuel injector device when said period has not lapsed and when the rotational speed of the engine N is larger than $N_1$ plus $\alpha$;

(g) producing an electrical signal for operating the fuel injector device when said period has not lapsed and when the rotational speed of the engine N is smaller than $N_2$ plus $\beta$;

(h) producing the electrical signal for stopping the operation of the fuel injector when the period has lapsed and when the rotational speed of the engine N is larger than $N_1$;

(i) producing the electrical signal for operating the fuel injector when the period has lapsed and when the rotational speed of the engine N is smaller than $N_2$;

(j) repeating the above mentioned steps during fully closed position of the throttle valve of the engine.

2. A method according to claim 1, wherein the detection of the period in (e) is effected by detecting a time after the starter of the engine is operated.

3. A method according to claim 1, wherein the detection of the period in (e) is effected by detecting a time after the starter of the engine is stopped.

4. A method according to claim 1, wherein the value $\alpha$ in (b) is decreased in accordance with the duration time after the engine is started.

5. A method according to claim 1, wherein the value in (c) is decreased in accordance with the duration time after the engine is started.

6. A method according to claim 4, wherein $\Delta\alpha$ is a predetermined positive small value, and a decrease in the value is effected by subtracting $\Delta\alpha \times t$ from $\alpha$ in the previous cycle.

7. A method according to claim 4, wherein a decrease in the value is effected by subtracting $\Delta\beta \times t$ ($\Delta\beta$ is a predetermined positive small value) from $\beta$ in the previous cycle.

* * * * *